US010597206B2

(12) United States Patent
Corey et al.

(10) Patent No.: US 10,597,206 B2
(45) Date of Patent: Mar. 24, 2020

(54) MEDICINE CONTAINER COVER

(71) Applicants: Kenneth Corey, Millbury, MA (US); Sarah Hanley, Millbury, MA (US)

(72) Inventors: Kenneth Corey, Millbury, MA (US); Sarah Hanley, Millbury, MA (US)

( * ) Notice: Subject to any disclaimer, the term of this patent is extended or adjusted under 35 U.S.C. 154(b) by 0 days.

(21) Appl. No.: 16/009,371

(22) Filed: Jun. 15, 2018

(65) Prior Publication Data

US 2019/0382172 A1 Dec. 19, 2019

(51) Int. Cl.

| | |
|---|---|
| ***A61J 7/00*** | (2006.01) |
| ***B65D 51/28*** | (2006.01) |
| ***A61J 1/03*** | (2006.01) |
| ***B65D 43/02*** | (2006.01) |

(52) U.S. Cl.

CPC ..... *B65D 51/2807* (2013.01); *A61J 1/03* (2013.01); *B65D 43/0235* (2013.01)

(58) Field of Classification Search

USPC ..... 700/231–244

See application file for complete search history.

(56) References Cited

U.S. PATENT DOCUMENTS

| | | | | |
|---|---|---|---|---|
| 4,967,935 | A | 11/1990 | Celest | |
| 6,249,717 | B1 | 6/2001 | Nicholson et al. | |
| 6,546,281 | B1 | 4/2003 | Zhang et al. | |
| 6,945,393 | B2 * | 9/2005 | Cho | B65D 51/24 206/219 |
| 7,392,918 | B2 * | 7/2008 | Holloway | A61J 1/03 221/151 |
| 8,357,114 | B2 | 1/2013 | Poutiatine et al. | |
| 9,061,879 | B2 | 6/2015 | Patthey | |
| 9,744,129 | B2 | 8/2017 | Palmer et al. | |
| 9,801,852 | B2 | 10/2017 | Allphin | |
| 2006/0018837 | A1 | 1/2006 | Preston et al. | |
| 2006/0076011 | A1 | 4/2006 | Rasor et al. | |
| 2007/0186923 | A1 * | 8/2007 | Poutiatine | A61J 7/0038 128/200.14 |
| 2009/0180936 | A1 * | 7/2009 | Anderson | A61K 9/7023 422/129 |
| 2010/0305750 | A1 | 12/2010 | Conley | |
| 2011/0226817 | A1 * | 9/2011 | Ortenzi | A61J 1/03 222/424.5 |
| 2014/0183070 | A1 | 7/2014 | Holaday et al. | |
| 2014/0297028 | A1 | 10/2014 | Bilotti | |
| 2014/0353328 | A1 | 12/2014 | Makhalfeh et al. | |
| 2015/0014252 | A1 | 1/2015 | Justus, Sr. | |
| 2015/0202588 | A1 * | 7/2015 | Allphin | A61K 31/19 514/282 |
| 2016/0008277 | A1 | 1/2016 | Crystal et al. | |
| 2016/0158107 | A1 * | 6/2016 | Dvorak | A61J 7/0084 241/25 |
| 2016/0213628 | A1 | 7/2016 | Omidian et al. | |

FOREIGN PATENT DOCUMENTS

| | | |
|---|---|---|
| WO | 2005054742 | 6/2005 |
| WO | 2017027673 | 2/2017 |

* cited by examiner

*Primary Examiner* — Timothy R Waggoner

(74) *Attorney, Agent, or Firm* — Lambert Shortell & Connaughton; Gary E. Lambert; David J. Connaughton, Jr.

(57) ABSTRACT

A cover for a medicine container is provided. The cover contains a deactivating material within it which can, upon release into a medicine container, deactivate and/or destroy a medicine within the container. The cover may have an automated release mechanism which controls release of the deactivating material into the medicine container.

16 Claims, 2 Drawing Sheets

MEDICINE CONTAINER COVER

BACKGROUND OF THE INVENTION

Field of the Invention

The present invention relates covers for medicine containers. More particularly the present invention relates to a cover for a medicine container which contains a material to destroy and/or deactivate medicine within the container.

Description of Related Art

There is an ongoing epidemic of abuse of medicines such as opioids and other prescription medicine, leading to abuse and addiction. Often times, non-prescribed household members can access medicine prescribed to others, in particular unused opioids, and become addicted or otherwise abuse the non-prescribed medicines. Current prescription medication packaging is relatively easy to access and is not a deterrent or barrier for an abuser.

Therefore, what is needed is a device that may efficiently and effectively deactivate medicines to prevent abuse.

SUMMARY OF THE INVENTION

The subject matter of this application may involve, in some cases, interrelated products, alternative solutions to a particular problem, and/or a plurality of different uses of a single system or article.

In one aspect, a cover for a medicine container is provided. The cover is formed of a top layer forming a top surface of the cover, as well as a wireless controller layer, a motor layer, and a deactivating material layer which contains a material which can deactivate a medicine within the medicine container. The wireless controller layer includes computerized components which are operable to control release of the deactivating material by an opening mechanism within the cover. In many embodiments, a motor or other movement structure is positioned within the cover on a layer separate from the wireless controller layer. Upon actuation of the motor by the computerized controller, an opening mechanism may move to release the deactivating material. When attached to a medicine container, the cover forms a container assembly operable to deactivate a medicine within the medicine container.

In another aspect, a cover for a medicine container is provided. The cover has a body attachable to the medicine container. The cover contains a deactivating material which can be automatically released from within the cover into the medicine container to deactivate a medicine within the container.

DETAILED DESCRIPTION

Figure 1:
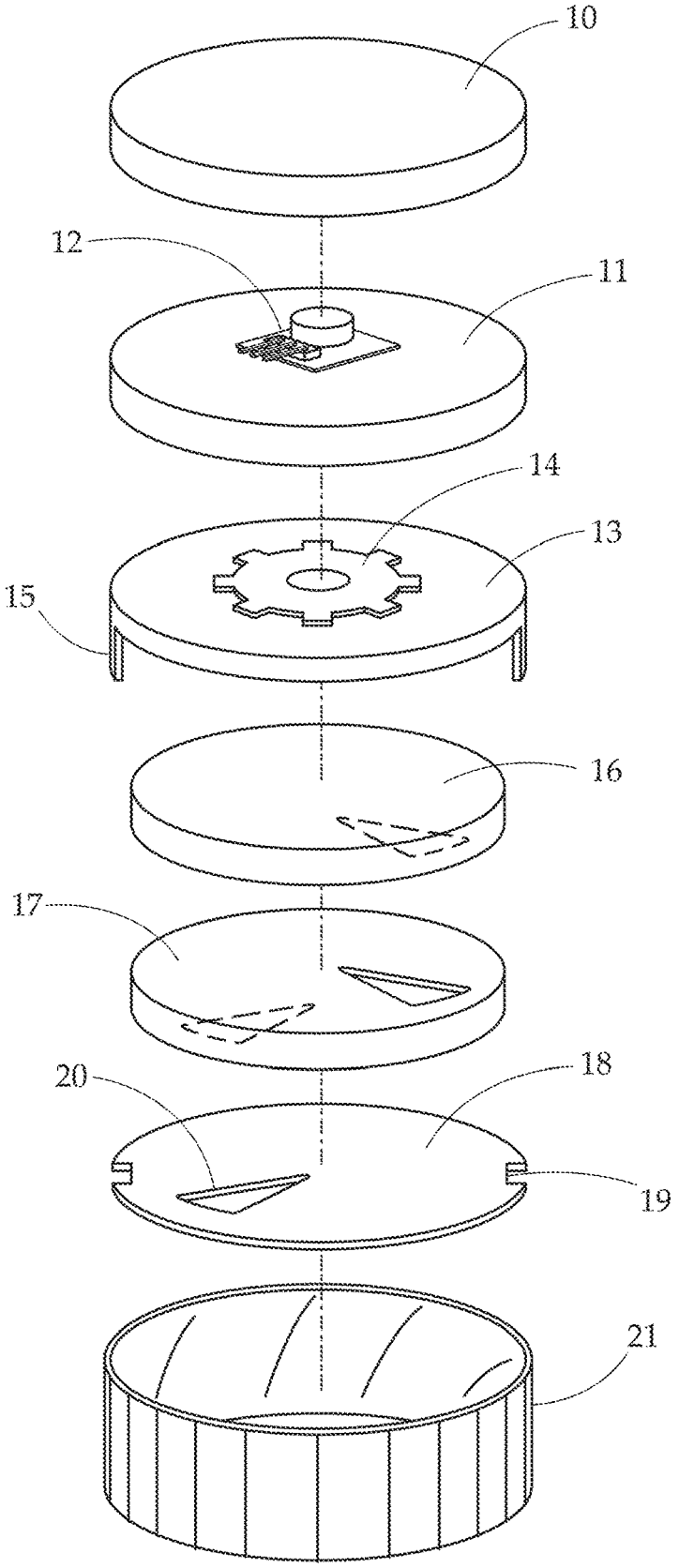
FIG. 1 provides an exploded view of an embodiment of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present disclosure concerns a cover for a container which stores medicine such as a pill bottle, among others. The cover contains a deactivating material which can be released into the container which destroys or deactivates medicine within. In many embodiments the cover includes an automated method to dispense the material within it, such as a small motor, among other options. Release of the material may be triggered by a timer, tampering, signal, or the like.

The cover of the present invention may be sized to fit on and operate like standard 33 mm pill bottle caps, with a child-safe operation. In other embodiments however, the cover may fit other sized containers without straying from the scope of this invention.

The deactivating material may be any material which may damage, destroy, encase, or otherwise make pills unusable for their purpose. Examples of the deactivating material include, but is not limited to activated charcoal, water, acid or base solutions, a curable adhesive, curable polymer, curable cement, epoxy, combinations of any of these, and the like. The mechanism of deactivation of the deactivating material may vary. For example, in some medicines, water, acids/bases, or other chemicals may break down the active ingredients sufficiently. For other medicines, activated charcoal may bind the active ingredients, making them no longer available upon consumption. For still other medicines, encasement may be preferable, such as by using a curable material which enters and surrounds the medicine in a liquid form, and then cures to solidify. In various embodiments, combinations of any or all of these methods may be used without straying from the scope of the present invention.

In a particular embodiment, the medicine container cover may be designed for use with a medicine container having opioid medicine therein. In such an embodiment, one method of deactivation of the opioids may include the release of activated charcoal, and/or the release of an encasing material such as a curable polymer or concrete, among others. In operation, the cover may release the two materials simultaneously or in series, such that the activated charcoal binds to the opioid while the encasing material cures to encase the pills. In some instances, the fluid of the pre-cured encasing material may partially dissolve pill components, making the components more available to the activated charcoal.

The cover may dispense the deactivating material in any manner using an opening mechanism. For example, a deactivating material container may be opened mechanically using an opening mechanism that may pierce or rupture a material container. Or, an opening mechanism may or move to open the container. Any opening mechanism that can open a closed deactivating material container may be used without straying from the scope of the present invention.

Turning now to FIG. 1, an exploded view of an embodiment of the medicine container cover which uses both an activated charcoal and curable material as deactivating materials is provided. As noted above, other embodiments having different or only one deactivating material are similarly contemplated by the present invention. In this view, the different components of the cover can be seen. A top layer 10 provides a top surface of the cover. A wireless controller layer 11 has a computerized controller 12 which includes a transceiver, micro controller, memory and power source. The controller 12 of the cover can, upon instruction to the micro controller received by the transceiver and/or programmed into the memory, activate an opening mechanism to release deactivating material into the container. A next motor layer 13 below the controller layer 11 has a motor 14 engaged with an opening mechanism. In this embodiment, the opening mechanism is a rotatable layer 13 with two depending arms 15. Depending arms 15 engage with a rotating disc 18 via slots 19, the remainder of the opening mechanism in this embodiment. Rotating disc 18 defines an opening 20 which, upon rotation to the proper position, aligns with an opening (not shown) in the deactivating material container layer 16 and/or 17 to release it into the medicine container. A standard locking rim 21 surrounds at least part of the varying layers when assembled. The cover may engage with the medicine container in any manner, including a twist or threaded connection, common "child-proof" connections, snap connections, and the like. While different components are described being on different layers, it should be understood that the components of the cover disclosed herein need not be segmented into layers, and may generally be contained within the cover and arranged in any manner.

The deactivating material container layers 16 and 17 are sized and configured to contain deactivating material. In the embodiment shown, each layer has an opening on a bottom surface such that when aligned with opening 20, the deactivating material within may be released. In other related embodiments, the container layers 16, 17 may be ruptured or pierced, or otherwise opened to allow release of contained material. As noted, a first deactivating material in the first container layer 16 may be activated charcoal, while a second deactivating material in second container layer 17 may be a curable material to encase the medicine within the medicine container. In a related embodiment, the container layers may be combined into a two compartment container layer having a vertical partition with one deactivating material in each compartment. In this embodiment, an opening may be on a bottom of each compartment, and the rotating disc 18 may rotate to a first position aligning the opening 20 with a first opening to release the first deactivating material, and then continue rotating to a second position aligning the opening 20 with a second opening to release the second deactivating material.

Figure 2:
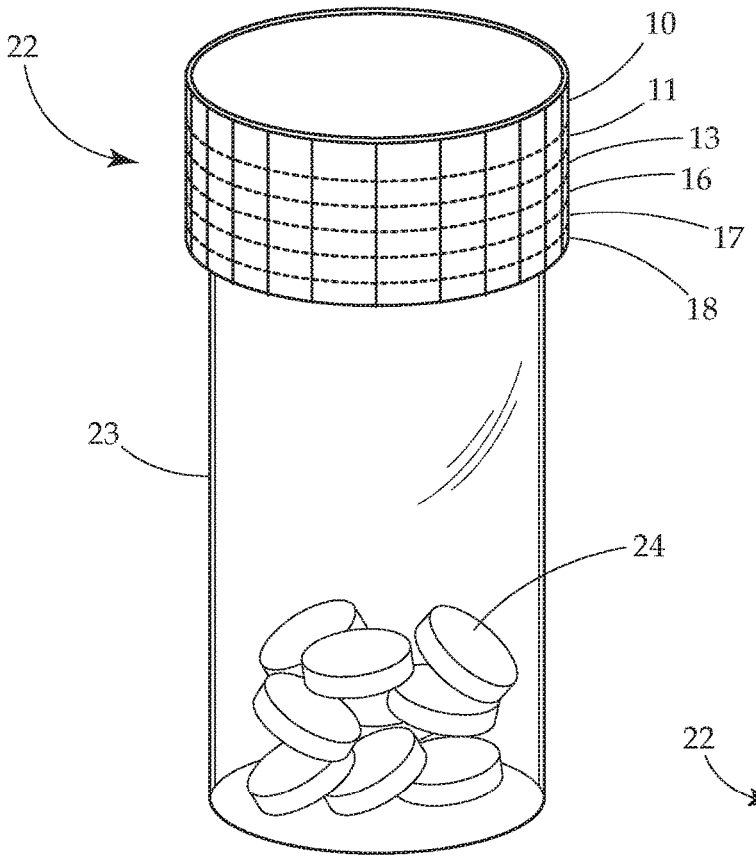
FIG. 2 provides a perspective view of an embodiment of the present invention attached to a medicine container.
Figure 3:
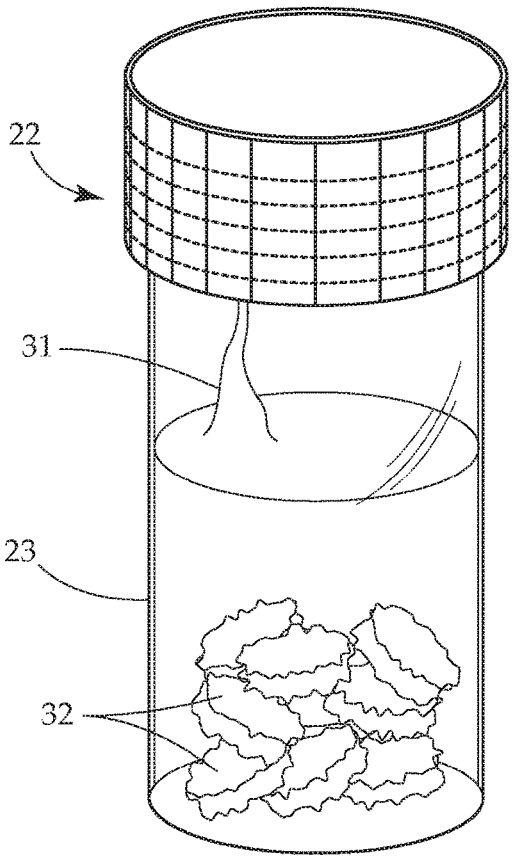
FIG. 3 provides a perspective view of another embodiment of the present invention attached to a medicine container.

FIGS. 2 and 3 show views of an embodiment of the medicine container cover before and after activation. The cover 22 body is attached to a standard 33 mm pill bottle 23. Within the bottle 23 are a plurality of pills 24 which may be abused. Upon activation of the controller 12 (shown in FIG. 1) the deactivating material(s) 31 are released. The deactivating material(s) 31 destroys pills 32 and in some embodiments encases them.

The activation of the opening mechanism by the controller may be triggered by various events. In one embodiment, the computerized controller may be programmed to activate the opening mechanism, thus releasing the deactivating material, after a predetermined amount of time. In another embodiment, the computerized controller may receive a signal input from the transceiver to activate the opening mechanism. In yet another embodiment, the computerized controller may identify, through a sensor, that the cover is being tampered with, which may trigger activation of the opening mechanism.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A cover for a medicine container comprising:

a top layer forming a top surface of the cover;

a wireless controller layer beneath the top layer, the wireless controller layer comprising a transceiver, micro controller, memory, and power source, wherein upon instruction to the micro controller, an opening mechanism within the cover is caused to be activated to release a deactivating material into the medicine container;

a motor mounted to a layer positioned beneath the wireless controller layer, the motor connected to the opening mechanism, the opening mechanism adapted to, upon actuation by the motor, release the deactivating material;

wherein the deactivating material comprises activated charcoal; and wherein the opening mechanism comprises a rotatable layer with at least one depending arm, the at least one depending arm engaged with a rotatable disc with an aperture alignable with an opening in a first deactivating material layer, such that upon rotation of the rotatable layer, the rotatable disc is moved to an open position allowing a release of the deactivating material.

2. The cover for the medicine container of claim 1 wherein the deactivating material further comprises a curable encasing material.

3. The cover for the medicine container of claim 1 wherein the cover further comprising a second deactivating material, the second deactivating material being a curable encasing material, the opening mechanism operable to release the second deactivating material.

4. The cover for the medicine container of claim 3 wherein the micro controller activates the opening mechanism to release the first deactivating material, and then to release the second deactivating material after the first deactivating material is released.

5. The cover for the medicine container of claim 1 wherein the instruction to the micro controller is received by the transceiver.

6. The cover for the medicine container of claim 1 wherein the instruction to the micro controller is programmed into the memory.

7. The cover for the medicine container of claim 6 wherein the memory is programmed to provide the instruction to the micro controller after a predetermined time period.

8. The cover for the medicine container of claim 1 wherein the instruction to the micro controller is received upon a tampering with the cover.

9. A medicine container assembly comprising:

a medicine container defining a cavity; and a cover attached to the medicine container, the cover comprising:

a top layer forming a top surface of the cover;

a wireless controller layer beneath the top layer, the wireless controller layer comprising a transceiver, micro controller, memory, and power source, wherein upon instruction to the micro controller, an opening mechanism within the cover is caused to be activated to release a deactivating material into the medicine container;

a motor mounted to a layer positioned beneath the wireless controller layer, the motor connected to the opening mechanism, the opening mechanism adapted to, upon actuation by the motor, release the deactivating material from a first deactivating material container layer; and wherein the opening mechanism comprises a rotatable layer with at least one depending arm, the at least one depending arm engaged with a rotatable disc with an aperture alignable with an opening in the first deactivating material layer, such that upon rotation of the rotatable layer, the rotatable disc is moved to an open position allowing a release of the deactivating material.

10. The medicine container assembly 9 wherein the deactivating material is activated charcoal.

11. The medicine container assembly 9 wherein the deactivating material is a curable encasing material.

12. The medicine container assembly 9 wherein the deactivating material is activated charcoal and the cover further comprising a second deactivating material, the second deactivating material being a curable encasing material, the opening mechanism operable to release the second deactivating material.

13. The medicine container assembly 12 wherein the micro controller activates the opening mechanism to release the first deactivating material, and then to release the second deactivating material after the first deactivating material is released.

14. The medicine container assembly 9 wherein the instruction to the micro controller is received by the transceiver.

15. The medicine container assembly 9 wherein the instruction to the micro controller is programmed into the memory.

16. The cover for the medicine container of claim 15 wherein the memory is programmed to provide the instruction to the micro controller after a predetermined time period.

* * * * *